United States Patent [19]

Searl

[11] Patent Number: 4,706,465

[45] Date of Patent: Nov. 17, 1987

[54] ICE PIECE EJECTION MECHANISM FOR ICEMAKER

[75] Inventor: Stephen Searl, Louisville, Ky.

[73] Assignee: General Electric Company, Louisville, Ky.

[21] Appl. No.: 915,622

[22] Filed: Oct. 6, 1986

[51] Int. Cl.[4] ..... F25C 5/04

[52] U.S. Cl. ..... 62/137; 62/833

[58] Field of Search ..... 62/71, 137, 353

[56] References Cited

U.S. PATENT DOCUMENTS

| | | | |
|---|---|---|---|
| 2,717,495 | 9/1955 | Andersson | 62/4 |
| 2,949,749 | 8/1960 | Reddi | 62/137 |
| 3,039,277 | 6/1962 | Frei et al. | 62/71 |
| 3,362,181 | 1/1968 | Linstromberg | 62/353 |
| 3,397,553 | 8/1968 | Crowe et al. | 62/353 |
| 3,678,701 | 7/1972 | Powell et al. | 62/353 |

*Primary Examiner*—William E. Tapolcai
*Attorney, Agent, or Firm*—Frederick P. Weidner; Radford M. Reams

[57] ABSTRACT

An icemaker including a freezer mold having a front side and a back side with a plurality of partitioned walls disposed within the mold to define a plurality of cavities along the longitudinal central axis of the mold in which water is frozen to form ice pieces having a crescent shape with a flat side and an arcuate side joined to form two edge portions. A stripper member is disposed longitudinally along the front side of the mold and has a portion thereof above the cavities. An ice piece ejector is rotatable in only one direction and has its axle along the longitudinal central axis of the mold. An ice piece ejector guide is secured to the back side of the mold and located above the cavities longitudinally along the mold, aid guide extending laterally from the rear of the mold past the axle of the rotating ejector and spaced from the rotating ejector axle a distance slightly greater than the maximum thickness of the ice piece. The guide and rotating ejector cooperate to move the ice pieces above the cavities between the guide and axle of the rotating ejector and force the ice pieces onto the stripper member to thereby move any previously harvested ice pieces off the stripper member.

10 Claims, 8 Drawing Figures

FIG. 1
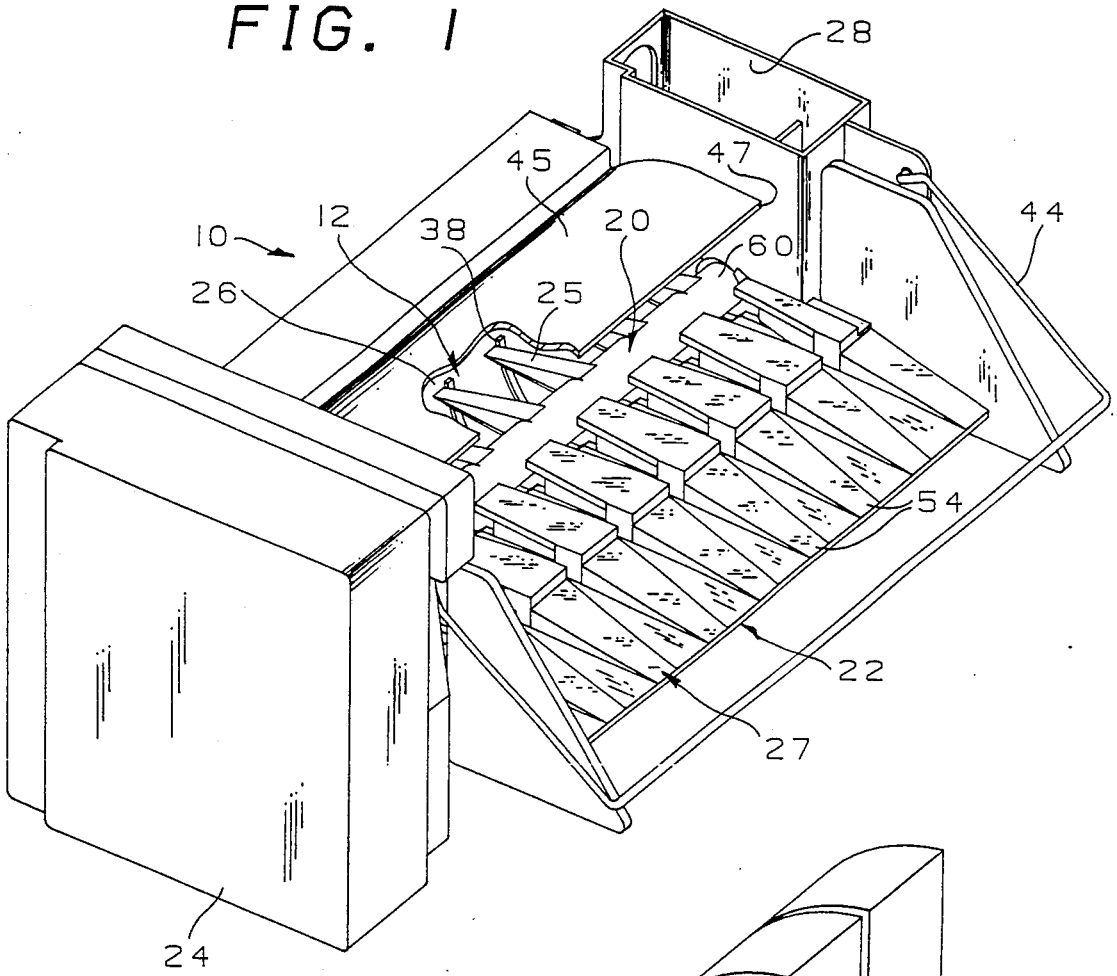
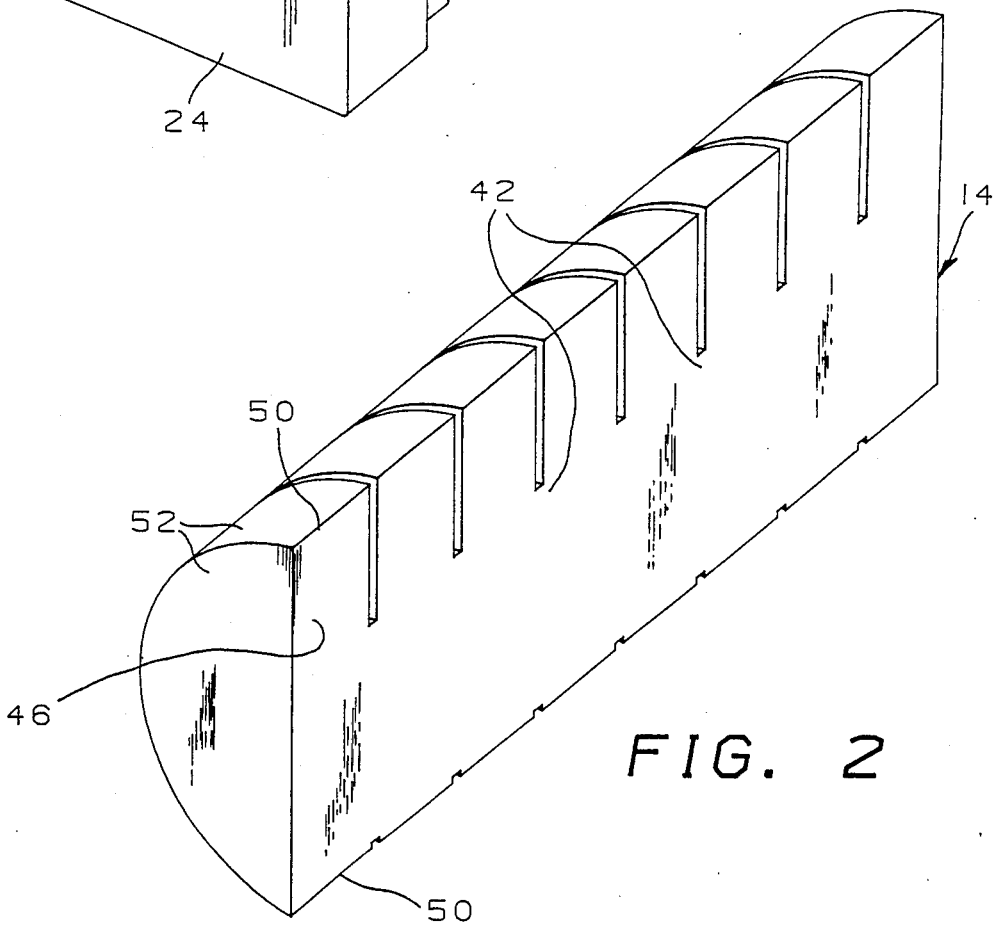
FIG. 2

ICE PIECE EJECTION MECHANISM FOR ICEMAKER

BACKGROUND OF THE INVENTION

This invention relates generally to an ice piece ejection mechanism for icemakers. In particular it relates to an icemaker with a mold that forms the ice pieces into crescent shaped pieces usually joined together by a thin web of ice and is an improvement upon the prior art ejection mechanism of such an icemaker. Automatic icemakers of this type usually have an underlying storage bin into which the ice pieces fall when harvested from the icemaker mold. To prevent overfilling the bin, the icemaker has a feeler arm which may be periodically lowered into the bin and raised to an elevated position. During each cycle of the icemaker the feeler arm is lowered and if it strikes ice pieces preventing it from reaching its lower position a switching arrangement prevents harvesting the ice pieces until the feeler arm can subsequently reach its lower position. In icemakers of the type involved it is desirable to eject the ice pieces from the crescent cube icemaker so that they fall into the storage bin further from the icemaker in lateral distance. This prevents ice piece build up in the storage bin directly under the mold. It is also desirable that the ice pieces fall in a manner to maximize impact breakup of the thin webs of ice joining the ice pieces together. This allows for better operation of any automatic ice piece dispenser associated with the icemaker and the ice pieces ejected therefrom. Users of the ice pieces also prefer that they be in individual pieces. It is further desirable that the ice pieces fall into an underlying storage bin after the feeler arm of the icemaker is fully raised, thus preventing later raising of the feeler arm causing ejected ice pieces to be pushed out of the storage bin during that motion.

One ice piece ejection mechanism that provides for the ice pieces to fall further from the icemaker in lateral distance than previously and tumble end over end into the storage bin, thus maximizing the force to aid in breaking the web between the ice pieces being ejected from the icemaker is disclosed in U.S. Pat. No. 4,614,088 and assigned to the same assignee of the present invention. The ice piece ejection mechanism disclosed in the patent also allows time for the feeler arm to be in its raised position and therefore not be hampered in its operation due to the ice pieces falling on top of the feeler arm when in its down position. While the ice piece ejection mechanism disclosed and claimed in U.S. Pat. No. 4,614,088 has been found satisfactory under most situations there are some dispensing situations that could be improved by modifying the icemaker in accordance with the present invention as will be discussed later.

The icemaker to which the present invention specifically relates is described in detail in U.S. Pat. No. 3,276,225 and one of the ways of ejecting ice pieces from such an icemaker is disclosed in U.S. Pat. No. 2,949,749. The problem with the ejecting means of U.S. Pat. No. 2,949,749 is that it requires rotating the ejector twice and in two opposite directions, thus there must be two harvest operations to finally deposit the ice pieces into the storage bin. This detrimentally affects the rate at which ice pieces are delivered to the storage bin for use.

By this invention an improved icemaker is provided that harvests and delivers crescent ice pieces to an underlying storage bin.

SUMMARY OF THE INVENTION

The present invention relates to an icemaker comprising a freezer mold having a front wall and a back wall with a plurality of partitioned walls disposed within the mold to define a plurality of cavities along the longitudinal central axis of the mold in which water is to be frozen to form ice pieces having a crescent shape with a flat side and an arcuate side joined to form two opposite edge portions. A stripper member is disposed longitudinally along the front wall of the mold and has a portion thereof above the cavities. Means for ejecting the ice pieces from the mold are provided and includes an ejector rotatable in only one direction and having its axle along the longitudinal central axis of the mold. An ice piece ejector guide is secured to the back wall of the mold and located above the cavities longitudinally along the mold. The ice piece ejector guide extends laterally from the rear of the mold past the axle of the rotating ejector and is spaced from the rotating ejector axle a distance slightly greater than the maximum thickness of the ice piece. The ice piece ejector guide and rotating ejector cooperate to move the ice pieces from the cavity between the guide and axle of the rotating ejector to force the ice pieces onto the stripper member to thereby move any previously harvested ice pieces off the stripper member.

BRIEF DESCRIPTION OF THE DRAWINGS

FIG. 1 is a perspective view of the icemaker embodying the present invention.

FIG. 2 is an array of crescent shaped ice pieces joined together by webs of ice of the type made in the icemaker shown in FIG. 1.

DESCRIPTION OF THE PREFERRED EMBODIMENT

Figure 6:
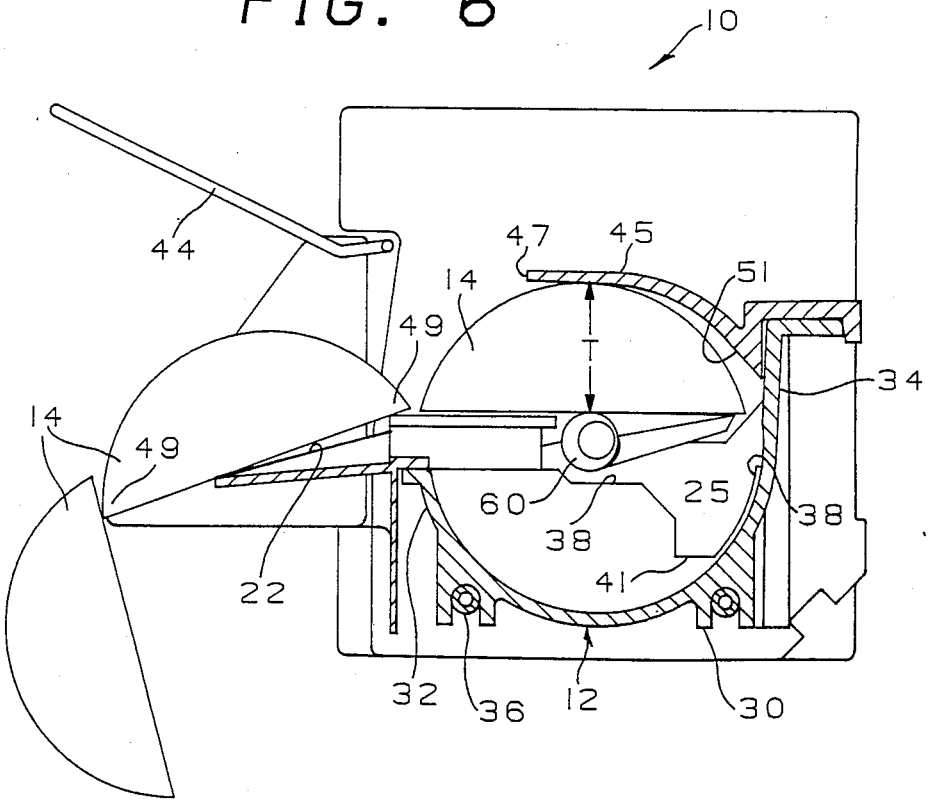
FIG. 6 is similar to FIGS. 3–5 and shows the fourth stage of ejecting the ice pieces from the icemaker.

The icemaker 10 as shown in FIG. 1 includes a metal mold 12 in which the ice pieces 14 (FIG. 2) are formed and from which the ice pieces are ejected to an underlying storage bin 16 (FIGS. 3 and 4) defining a collecting space 18, by means of a rotating ejector 20 which sweeps through the mold during the ejection cycle. The ejector 20 has spaced projections 25 in a common plane tangent to the axle 60 of the ejector 20, one for each of the ice pieces formed in the mold and when rotated the ejector 20 sweeps the ice pieces 14 out of the mold 12 and against a stripper member 22 which effectively strips the ice pieces 14 from the ejector 20. Stripper member 22 is made of a single plastic molded part and has spaced apart tooth shaped projections 23 on one side projecting above the mold toward the center of the mold 12 and the other side has a downwardly declining portion 27. The stripper member 22 is secured to the front wall 32 of mold 12 by any suitable means. An ice piece ejector guide 45 is secured to the back wall 34 of the mold 12 in any suitable manner and is located above the cavities longitudinally along the mold. The guide 45 is arcuate shaped with a free terminal end 47 and extends laterally from the back wall 34 of the mold past the axle of the rotating ejector 20 and is spaced from the rotating ejector axle a distance slightly greater than the maximum thickness designated "T" of the ice piece (FIG. 6).

Cyclical operation of ejector 20 is automatically effected by a control generally indicated as 24 disposed at the forward end of the mold 12. In addition to cycling the ejector 20, control 24 further automatically provides for refilling the mold with water for subsequent further ice piece formation therein. For a detailed description of the operation of the control 24, reference may be had to the hereinbefore identified U.S. Pat. No. 3,276,225. Mold 12 defines a plurality of upwardly open cavities 26 in which ice pieces 14 are formed. The water from which the ice pieces are formed is delivered to mold 12 by means of an inlet structure 28 that empties into the mold 12 and is supplied with water by a supply tube (not shown) that is operated by a solenoid valve (not shown). It will be understood that the valve is connected to a suitable source of water under pressure for delivery of the water to the water inlet structure 28.

Figure 3:
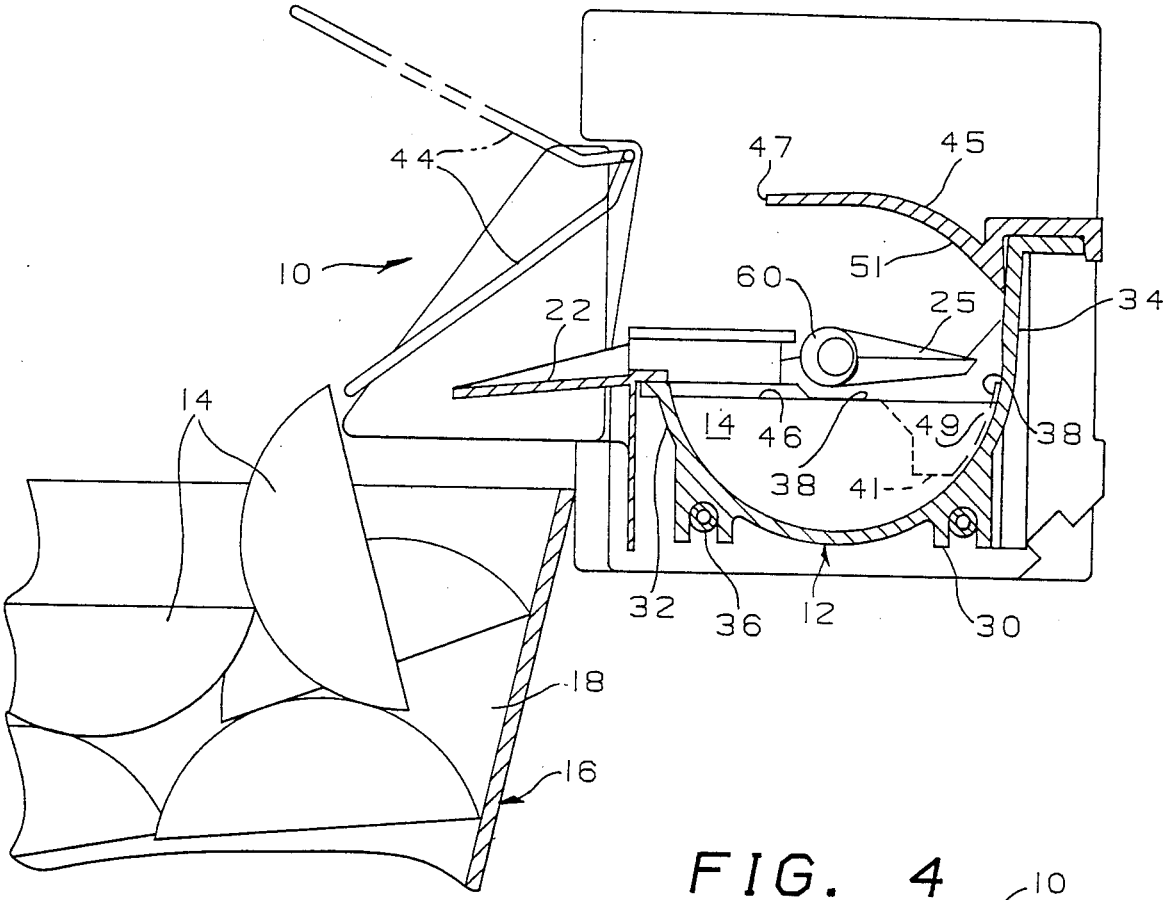
FIG. 3 is a cross-sectional view of the icemaker shown in FIG. 1 in the first stage of ejecting ice pieces from the icemaker and showing the ice piece accumulation in an underlying storage bin.

With reference to FIGS. 1–3, the icemaker more specifically comprises a metal mold 12 with a tray structure having a bottom wall 30, front wall 32 and back wall 34. A sheathed electric resistance heating element 36 is positioned by pressing it into the bottom wall 30 to heat the mold 12 during the ejection operation to slightly melt the ice pieces and release them from the mold cavities 26, thus aiding in the ejection operation. A plurality of partition walls 38 extend transversely across the mold to define with the above-indicated tray walls the cavities 26 in which the ice pieces 14 are formed. Each of the partition walls 38 is provided with a recessed upper edge portion 41 through which water flows from the end cavity successively forward to the respective cavities until all the cavities are filled with water. As can be seen in FIG. 2 a connecting ice portion or web 42 is formed on the ice pieces 14 where the recessed upper edge portion 41 of the partition walls 38 are located and the webs 42 are preferably sufficiently strong to prevent breaking of the ice piece during the normal ejection from the mold cavity 26. However, it is desirable that the ice pieces 14 be separated from each other upon delivery into the underlying storage bin 16. The reason for separating the ice pieces into individual ice pieces if possible is so that subsequent dispensing of the ice pieces through an automatic dispenser is more readily accomplished and also the user of the ice pieces from the storage bin usually prefers that they be in separate form rather than in strips as shown in FIG. 2.

In order to sense the level of ice pieces 14 as they accumulate in the underlying storage bin 16 there is a feeler arm 44 and mechanism (not shown) actuated by control 24 for controlling the automatic harvesting operation so as to maintain a preselected level of ice pieces in the collecting space 18. The feeler arm 44 is automatically raised and lowered periodically during operation of the icemaker so that upon its being lowered into the underlying storage bin 16 should it encounter and be obstructed by the level of ice pieces in the storage bin preventing it from reaching its lowered position it will signal the icemaker control 24 to discontinue harvesting ice pieces because the bin 16 is full. Once the ice pieces 14 in the bin have been sufficiently removed and the feeler arm 44 can reach its lowered position the control signals the icemaker to initiate and continue making ice pieces and harvesting them until once again the feeler arm 44 detects ice pieces by obstruction when being moved to its lowered position. It will be appreciated that the feeler arm 44 is raised to an upper position and lowered to a lower position periodically and that it is desirable to have the feeler arm in its raised position during harvesting of the ice pieces so that the ice pieces do not fall or tumble onto the feeler arm in which event when the feeler arm 44 is raised it may cause the ice pieces to be shoved or moved outside the walls of the storage bin.

As mentioned in the Background of the Invention section the ice piece ejection mechanism disclosed and claimed in U.S. Pat. No. 4,614,088 has been found satisfactory under most situations; however, there are some dispensing situations that could be improved by modifying the icemaker in accordance with this invention. As disclosed in that application a stripper member is disposed longitudinally along one side of the mold with a portion thereof above the cavities and having an upwardly depending ridge. The ejection of the ice pieces from the mold is provided by a rotating ejector that moves the ice pieces above the cavities and continues rotating the ejector and moving the ice pieces onto the stripper member such that the edge portion of the ice pieces engage the upwardly depending ridge of the stripper member and are retained by that ridge. However, continued rotation of the ejector pivots the ice pieces upwardly about the edge portion and past the vertical whereupon the ice pieces tumble off the stripper member laterally outward of the mold. One problem with this arrangement is that when ice piece end portions stick up above the edge of the stripper member such as when the storage bin for the ice pieces is full but yet does not project high enough for the feeler arm to detect it, then the ejected ice pieces are stopped on the stripper member and are retained thereon by the ice pieces projecting above the stripper member. The result is that the next harvesting of the ice pieces from the mold may slide over the top of the ice pieces retained on the stripper member until the rotating ejector is disengaged from the ice pieces and then the ice pieces slide back into the mold and interfere with the next ice piece harvest operation. One solution to this problem is to decrease the distance between the edge of the stripper member and the feeler arm; however, when that is done an ejection of the ice pieces will cause them to lie on the edge of the stripper member and the feeler arm will lower and can trap an ice piece between the feeler arm and the edge of the stripper member, thus creating a false signal to shut off the icemaker even though the ice pieces in the storage bin have been depleted except for the ice piece trapped by the feeler arm.

Figure 4:
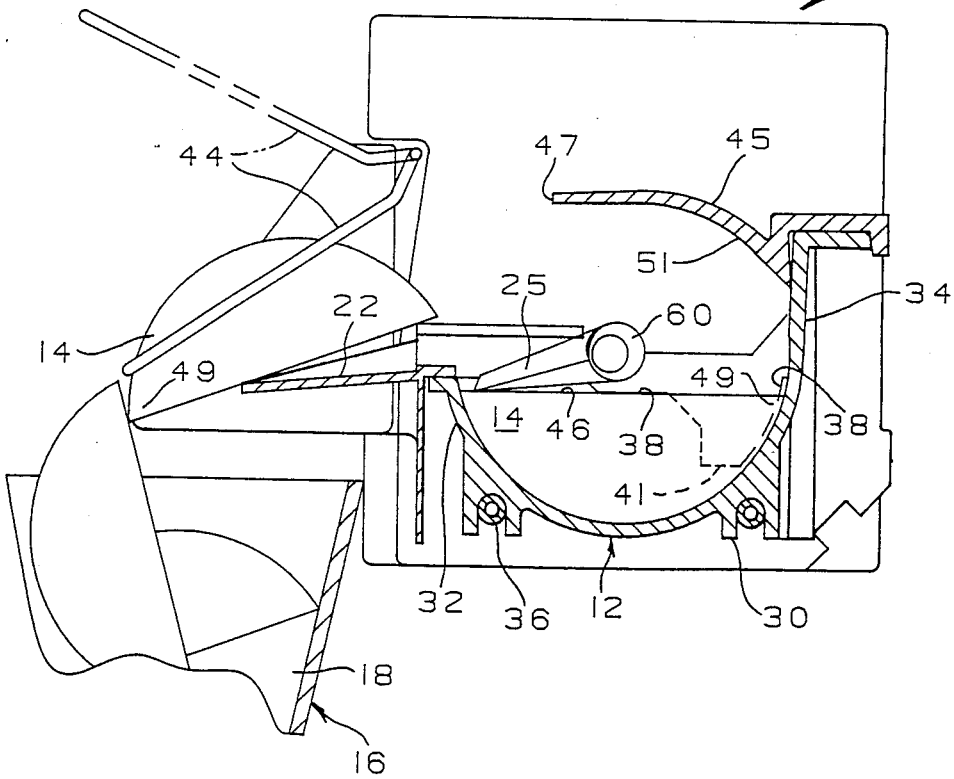
FIG. 4 is similar to FIG. 3 and shows the second stage of ejecting ice pieces from the icemaker and the ice pieces that have been harvested from the icemaker positioned on the stripper member and retained thereon by ice pieces in the storage bin.
Figure 5:
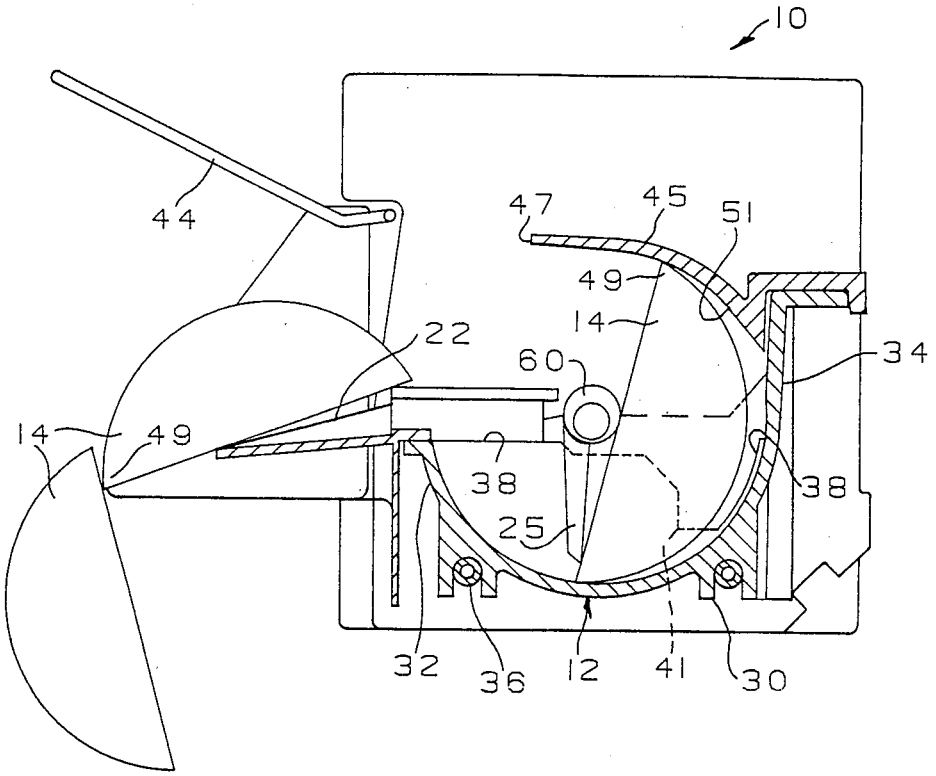
FIG. 5 is similar to FIGS. 3 and 4 and shows the third stage of ejecting the ice pieces from the icemaker.

With reference to FIGS. 3–8, the structural arrangement of the icemaker and operation thereof to solve the problem of the false indication to the feeler arm 44 that the storage bin 16 is full of ice pieces is shown. As seen in FIG. 3, the storage bin 16 has a number of ice pieces 14 piled up underneath the stripper member 22. As can be seen, the feeler arm shown in full line is in its lower position and senses whether or not there is enough ice pieces in the storage bin. As can be seen the feeler arm 44 in its lowered position does not detect any ice pieces 14. With reference to FIG. 4, after the next harvest of the ice pieces from that shown in FIG. 3, the ice pieces 14 are retained on the stripper member 22 because the forward edge portion 49 of the ice piece 14 is blocked by the flat side 46 of an ice piece that is projecting upwardly from the mass of ice pieces directly below the stripper member 22. In this position then as the feeler arm 44 is moved to its lowered position shown in full line it will strike the ice piece 14 being retained on the stripper member 22 and indicate to the control system that the ice making operation be discontinued. However, ice pieces from the rest of the storage bin 16 may be removed but the ice pieces held on the stripper member 22 by the feeler arm 44 may remain in that position for some length of time thus detrimentally affecting the ice piece harvesting operations. With the ice pieces in the position shown in FIG. 4, the ice piece harvesting operation in accordance with this invention to eliminate the above-mentioned problem will now be described.

Figure 7:
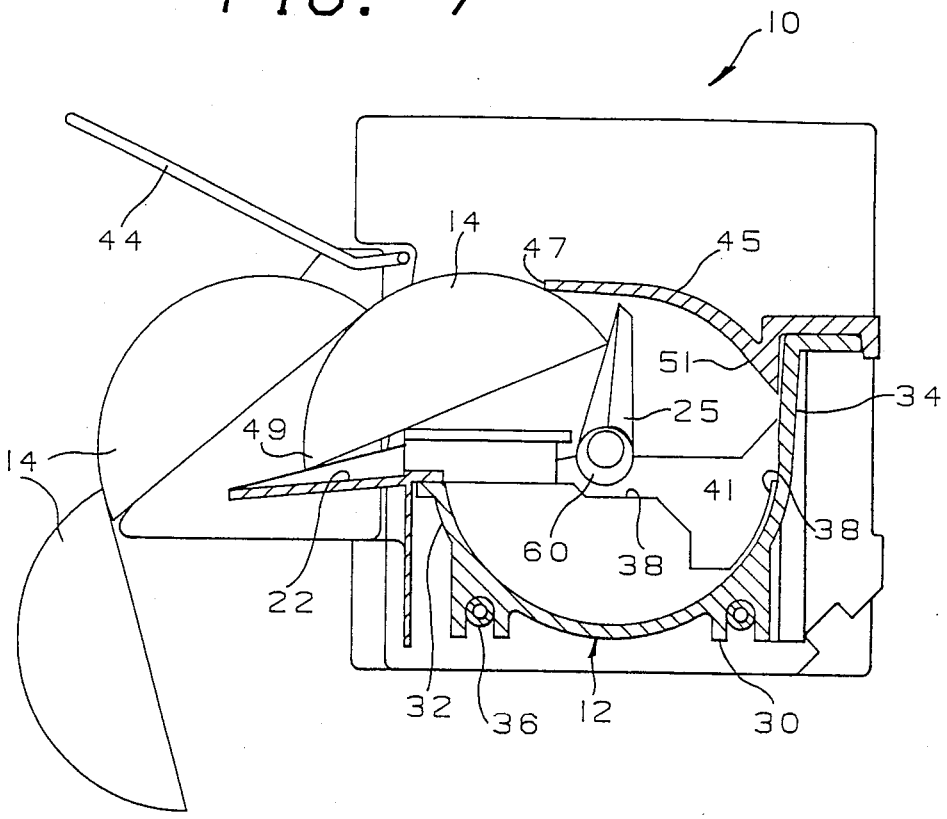
FIG. 7 is similar to FIGS. 3–6 and shows the fifth stage of ejecting the ice pieces from the icemaker.
Figure 8:
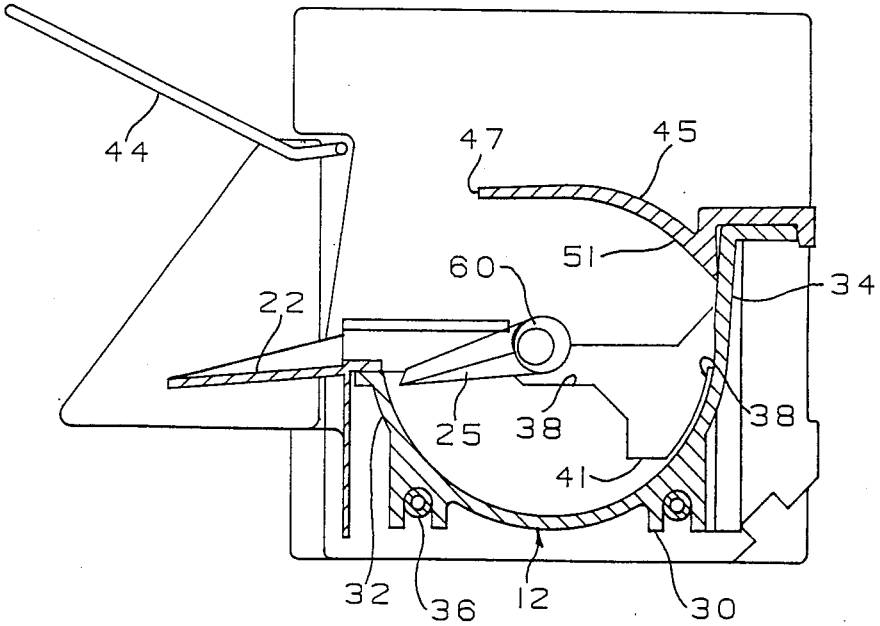
FIG. 8 is similar to FIGS. 3–7 showing the icemaker in position after harvesting ice pieces from the mold.

The ice piece harvesting operation is initiated by energization of heating element 36 to slightly melt the ice pieces 14 to release them from their respective mold cavities 26 and may be referred to as the first stage of ejecting the ice pieces from the icemaker (FIG. 3). Thereafter, the control and mechanism as shown in FIG. 4 (second stage) causes counter-clockwise rotation of the ejector 20 to the position shown in FIG. 4 where the ejector projections 25 engage the flat side 46 of the ice pieces to be removed from the mold 12 and apply an ejection force to the ice pieces. As the ejector 20 continues to rotate counter-clockwise the feeler arm 44 is swung outwardly from the mold 12 and is raised to its uppermost position as shown in full line in FIG. 5 (third stage) and the ejector forceably engages the upper flat side 46 of the ice pieces and urge the ice pieces outwardly from the mold cavities 26 in a pivotal movement. As the ice pieces are moved outwardly from the mold cavities 26 an edge portion 49 of the ice pieces engages the arcuate surface 51 of the ice piece ejector guide 45. Continued rotation of the ejector 20 causes the ice pieces 14 to rotate about the axle 60 of the ejector 20 and takes the position as shown in FIG. 6 (fourth stage) where the flat side 46 lies across the axle 21 of the ejector 20. It will be noted that the distance between the longitudinal central axle 60 of the ejector 20 and the arcuate surface 51 of the ice piece ejector guide 45 is slightly greater than the maximum thickness designated "T" of the ice piece. Continued counterclockwise rotational movement of the ejector 20 as shown in FIG. 7 (fifth stage) forces the ice pieces onto the stripper member 22 and if the previously harvested ice pieces are retained on the stripper member 22 as shown in FIG. 6, the ice pieces being forced out of the mold will engage the retained ice pieces on the stripper member and force these ice pieces off the stripper member and tumble them downwardly into the storage bin 16. The forces involved with this operation tend to break the thin webs 42 between the ice pieces 14 thereby separating the ice pieces from each other. Continued counterclockwise movement of the ejector 20 causes the strip or array of ice pieces 14 to engage the stripper member 22. The stripper member 22 is secured to the mold 12 such that tooth shaped projections 23 extend over and above each of the partition walls 38. The projections 23 are spaced from each other a distance sufficient to allow the projections 25 of the ejector 20 to pass therebetween during its rotational movement; however, the spacing is not enough to allow the ice pieces through so they cannot re-enter the cavities from which they came. The portion 27 of stripper member 22 has a surface 54 downwardly declining in a direction away from the mold 12. Continued rotation of the ejector will position the ejector as shown in FIG. 8 and in this position the ice pieces have by now been moved out into the storage bin and are no longer on the stripper member where they can continue blocking the feeler arm to give a false signal to stop the ice making operation. Subsequently, the ejector is moved to its position shown in FIG. 3 ready for the next ice making cycle.

While there is shown and described the preferred embodiment of this invention, it is to be understood that it is capable of many modifications. Changes, therefore, in the construction and arrangement may be made without departing from the spirit and scope of the invention as defined in the appended claims.

What is claimed is:

1. An icemaker comprising:

a freezer mold having a front wall and a back wall with a plurality of partitioned walls disposed within the mold to define a plurality of cavities along the longitudinal central axis of the mold in which water is to be frozen to form ice pieces having a crescent shape with a flat side and an arcuate side joined to form two opposite edge portions, a stripper member disposed longitudinally along the front wall of the mold and having a portion thereof above the cavities, means for ejecting the ice pieces from the mold including an ejector rotatable in only one direction and having an axle along the longitudinal central axis of the mold, and an ice piece ejector guide secured to the back wall of the mold and located above the cavities longitudinally along the mold, said guide extending laterally from the back wall of the mold past the axle of the rotating ejector and spaced from the rotating ejector axle a distance slightly greater than the maximum thickness of the ice piece, said guide and rotating ejector cooperating to move the ice pieces above the cavities between the guide and axle of the rotating ejector and force the ice pieces onto the stripper member to thereby move any previously harvested ice pieces off the stripper member.

2. The icemaker of claim 1 wherein the ice piece ejector guide is arcuate shaped to accommodate the arcuate side of the ice pieces.

3. The icemaker of claim 1 wherein the rotating ejector is formed of a plastic material and includes an axle and a plurality of spaced projections transversely outwardly from said axle, each of said projections being in a common plane tangent to said axle and apply ejection force to the ice pieces.

4. The icemaker of claim 1 wherein means are provided to heat the mold prior to ejecting the ice pieces from the mold.

5. The icemaker of claim 1 wherein there is an underlying receptacle to receive the ice pieces being ejected and forced off the stripper member of the mold.

6. The icemaker of claim 5 wherein means are provided for controlling the operation of the icemaker when the level of ice pieces in the receptacle rises above a predetermined level.

7. The icemaker of claim 6 wherein the means to control the icemaker includes a feeler arm which may be raised and lowered and is in its raised position during the forcing of the ice pieces onto the stripper member laterally outward of the mold.

8. The icemaker of claim 1 wherein the ice pieces being ejected from the mold have a thin web of ice joining them together.

9. The icemaker of claim 1 wherein the stripper member is inclined downwardly in a direction away from the mold.

10. The icemaker of claim 1 wherein the stripper member extends outwardly beyond the freezer mold.

* * * * *